United States Patent [19]

Strowe

[11] 4,171,534

[45] Oct. 16, 1979

[54] RECHARGEABLE FLASHLIGHT

[75] Inventor: Robert J. Strowe, Summerville, S.C.

[73] Assignee: Streamlight, Inc., Norristown, Pa.

[21] Appl. No.: 888,670

[22] Filed: Mar. 21, 1978

Related U.S. Application Data

[63] Continuation of Ser. No. 704,818, Jul. 13, 1976, abandoned.

[51] Int. Cl.[2] ..... F21L 9/00

[52] U.S. Cl. ..... 362/183; 362/205

[58] Field of Search ..... 362/183, 191, 202, 205

[56] References Cited

U.S. PATENT DOCUMENTS

| | | | |
|---|---|---|---|
| 2,236,338 | 3/1941 | Emanuel | 362/183 |
| 2,564,612 | 8/1951 | Schneider | 362/183 X |
| 3,787,678 | 1/1974 | Rainer | 362/183 |
| 3,976,986 | 8/1976 | Zabroski | 362/183 X |

*Primary Examiner*—William M. Shoop
*Assistant Examiner*—Peter S. Wong
*Attorney, Agent, or Firm*—Cooper, Dunham, Clark, Griffin & Moran

[57] ABSTRACT

A rechargable flashlight having an on/off switch housing with an accessible switch contact therein connectable to a battery charging circuit.

9 Claims, 8 Drawing Figures

Fig. 1.
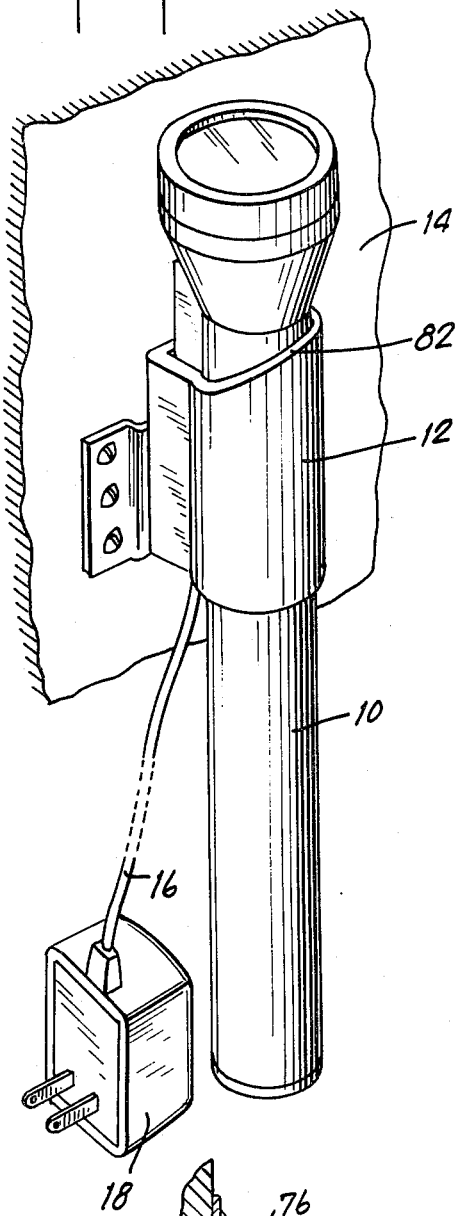
Fig. 2.
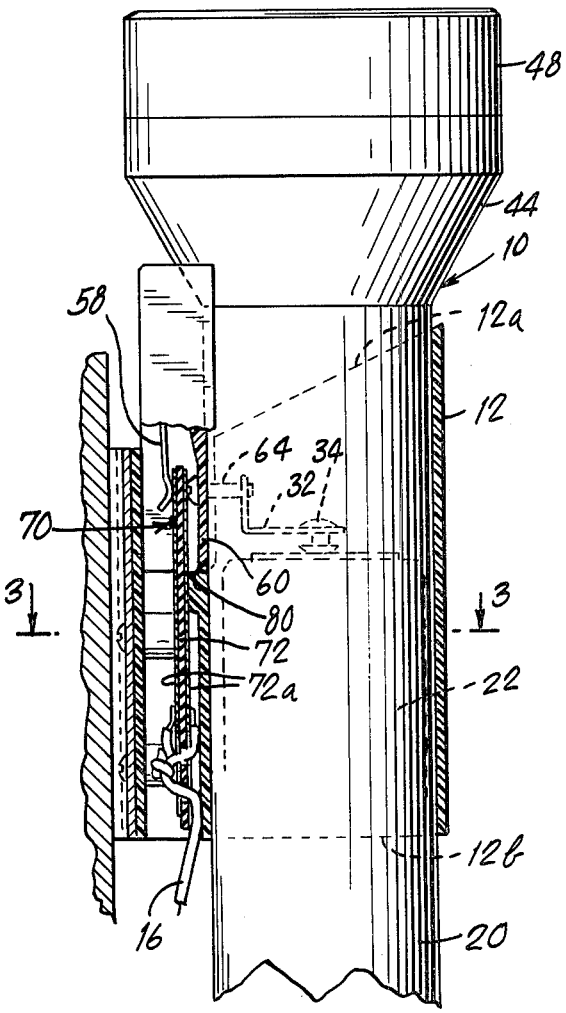
Fig. 3.
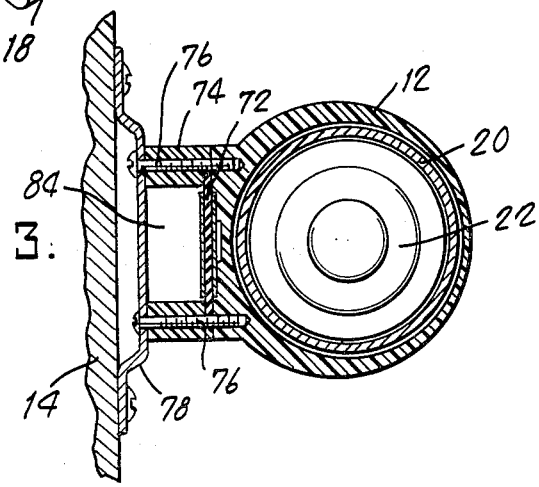
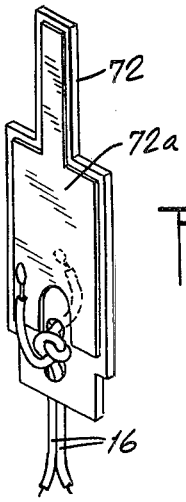
Fig. 4.

RECHARGEABLE FLASHLIGHT

This is a continuation, of application Ser. No. 704,818 filed July 13, 1976 now abandoned.

BACKGROUND AND BRIEF DESCRIPTION OF THE INVENTION

This invention relates to rechargable flashlights.

Rechargable flashlights are known. In general, all require separate charging contacts, thereby rendering the flashlight somewhat complicated and expensive to fabricate. In the present invention, in distinction, the charging contacts form part of the on/off switch for the flashligt, thereby simplifying fabrication and reducing the number of parts required.

In a presently preferred embodiment of the invention, an on/off switch contact is included within a channel having an open end through which a contact member of a battery charging circuit passes and is positioned within the channel in electrical contact-making position against the on/off switch contact. The contact member of the battery charging circuit is preferably carried within a tubular flashlight holder, within which the flashlight is positioned for battery recharging.

The following patents are representative of the prior art:

| U.S. Pat. No. | Patentee | Date of Issue | U.S. Class |
|---|---|---|---|
| 2,236,338 | Emanuel | March 25, 1941 | 240/10.6CH |
| 2,293,284 | Emanuel | August 18, 1942 | 240/10.6CH |
| 2,582,330 | Hautala | January 15, 1952 | 240/10.6CH |
| 3,217,224 | Sherwood | November 9, 1965 | 240/10.6CH |
| 3,643,083 | Heine | February 15, 1972 | 240/10.6CH |
| 3,737,649 | Nelson et al | June 5, 1973 | 240/6.42 |
| 3,749,905 | Friedman et al | July 31, 1973 | 240/10.6CH |
| 3,787,678 | Rainer | January 22, 1974 | 240/10.6CH |
| 3,829,676 | Nelson et al | August 13, 1974 | 240/10.6CH |

The invention will be more completely understood by reference to the following Detailed Description.

BRIEF DESCRIPTION OF THE DRAWING

FIG. 1 is a perspective view of a flashlight and holder embodying the invention.

FIG. 2 is a partly sectional view of the flashlight and holder of FIG. 1, to an enlarged scale.

FIG. 3 is a sectional view taken along the section 3—3 of FIG. 2.

FIG. 4 is a perspective view of a contact member forming a part of the holder of FIG. 3.

DETAILED DESCRIPTION

Figure 5:
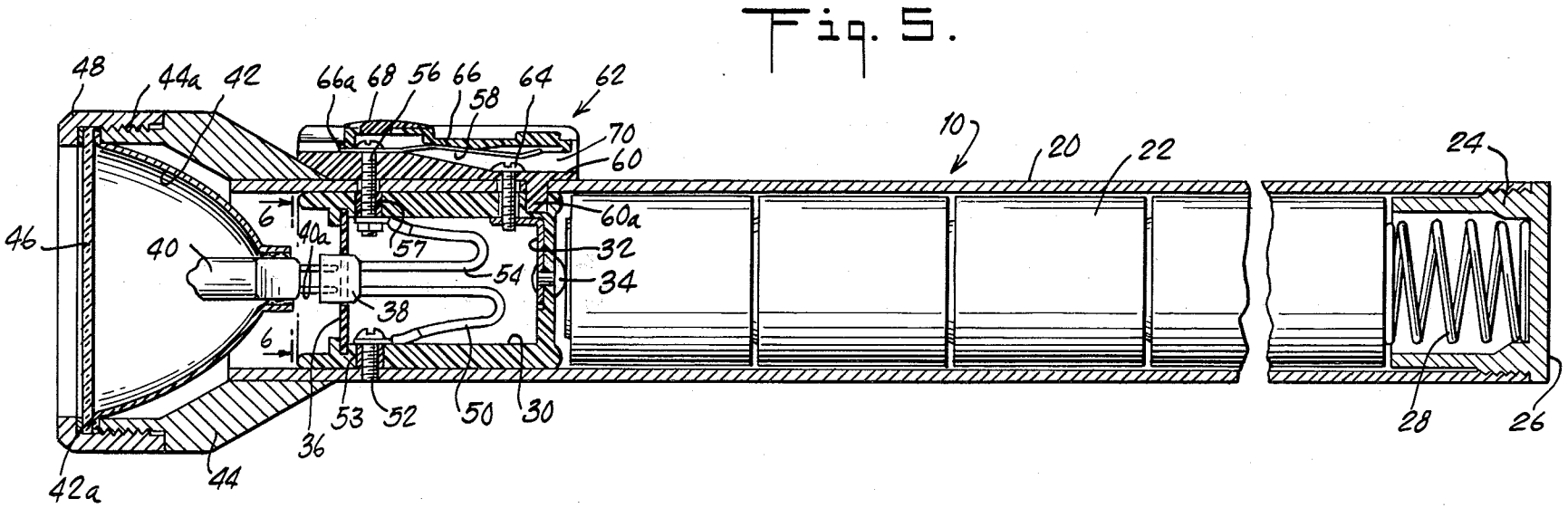
FIG. 5 is a longitudinal sectional veiw of a flashlight embodying the invention.

Referring to FIG. 1, a flashlight 10 positioned within and held by a holder 12 is shown. The holder 12 may be conveniently secured to a wall 14 and is connected by conductor 16 to a transformer/rectifier unit 18 which is typically plugged into a 110 volt outlet and which transforms the 110 volt AC signal to a suitable DC potential for charging the batteries within the flashlight 10.

Referring to FIG. 5, which shows the flashlight 10 in detail, it comprises a tubular casing 20, typically of metal, which encloses battery 22 therein. The casing 20 is threaded at one end thereof, as at 24, to receive a back cap 26. The back cap, which also may be of metal, positions a spring 28 of conductive material against one end of the battery 22.

The other end of the casing 20 has a socket mounting plug 30 mounted therein by a friction fit, for example. The socket mounting plug is preferably of electrical insulating material and carries a right-angle bracket 32 of electrical conducting material which is riveted to the plug by means of rivet 34. The rivet 34 makes electrical contact with one of the terminals of the battery 22.

Figure 6:
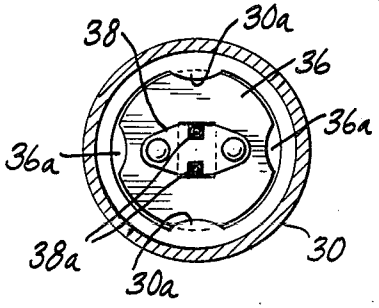
FIG. 6 is a sectional view of the flashlight of FIG. 5, taken along the section 6—6 in FIG. 5.

The plug 30 mounts a socket mounting plate 36 therein which in turn carries socket 38. FIG. 6 shows how the plate 36 is mounted in place. Specifically, the plug 30 includes ears **30*a* therein. The plate 36 is cut away, as at 36*a*, so that, when it is desired to position the plate 36 in place, the cutouts 36*a* pass by the ears 30*a*, and the entire plate is rotated 90° to the position shown in FIG. 6, held in place by the ears 30*a***.

A lamp 40 carried by a reflector 42 is positioned with electrical prongs **40*a* thereof inserted into corresponding contacts 38*a* of socket 38 (see also FIG. 6). The reflector 42 includes a flange 42*a* along the outer edge thereof which is sandwiched between neck 44 of the flashlight and lens 46. Lens 46 is held in place by a threaded cap 48 which is threaded onto threaded end 44*a* of the neck 44. The neck 44 may advantageously be force fitted, for example, onto the end of the flashlight casing 20**.

With this arrangement of socket mounting plug 30, in particular, including the socket mounting plate 36, the lamp 40 is held by a shock-resistant mounting, so that the flashlight is capable of withstanding severe shock, such as occasioned by the dropping of the flashlight or the striking of the flashlight against an object, without concurrent breaking of the lamp.

Referring again to FIG. 5, one of the terminals of the lamp socket 38 is connected by conductor 50 to a screw 52 which is threaded into casing 20 so as to "ground" one of the terminals of the lamp. Conductive bushing 53 ensures proper grounding. The other terminal of the socket 38 is connected via conductor 54 to screw 56. The screw 56 passes through the casing 20 without making electrical contact therewith and maintains an on/off switch contact 58 in place on the outside of the casing 20. Insulating bushing 57 is included to permit a relatively large size hole through plug 30 to permit screwdriver access to screw 52. The screw 56 passes through a body member 60, of electrical insulating material, which forms part of on/off switch housing 62. The body member 60 is positioned accurately in place on casing 20 by pin portion **60*a* thereof. The other switch contact of the on/off switch is constituted by screw 64, which also maintains the body member 60 of the switch housing in place and which passes through the casing 20 without making electrical contact therewith. The right-angled bracket 32 connected to the rivet 34 is securely threaded onto the other end of the switch contact screw 64**.

Figure 8:
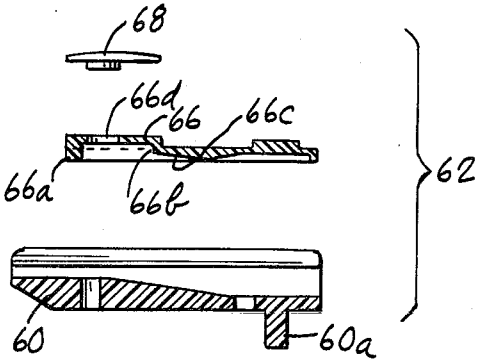
FIG. 8 is an exploded view of the on/off switch housing of the flashlight of FIG. 5.
Figure 7:
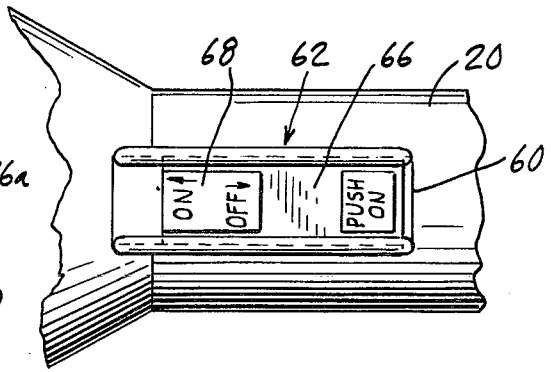
FIG. 7 is a partial top view of the flashlight of FIG. 5.

The on/off switch housing is completed by a slide 66 which slides along the switch body member 60 (see also FIGS. 7 and 8). A downwardly extending lip **66*a* on the front end of the slide 66 strikes the screw 56 and prevents the slide from being removed completely by movement in the rearward direction toward the back cap 26 of the flashlight. Downwardly projecting surface 66*b* of the slide strikes the screw 56 when the slide is moved forwardly toward the lens 46, preventing the slide from disengaging completely from the switch body member 60 in the forward movement of the slide. During such forward movement of the slide 66, wedge-shaped portion 66*c* of the slide causes downward movement of the switch contact 58, bringing that switch contact into engagement with the other switch contact 64, to complete an electrical circuit within the flashlight energizing the lamp 40. Momentary on/off operation may be achieved by depressing downwardly the rear part of the slide 66 to engage the switch contacts 58 and 64** in momentary on/off operation.

The switch slide 66 contains hole **66*d* therein for gaining access to the screw 56. The hole 66*d* is closed by a cap 68**.

It is apparent that the body and slide portions 60 and 66 of the switch housing 62 are spaced apart from each other at the rear portions thereof to define a channel 70 therebetween. That channel has an open end (adjacent the rear end of the switch body portion 60). The enclosed channel 70, open only at the rear end thereof, is useful in providing access to the switch contacts 58 and 64 so that these contacts may be used for battery charging, as will now be explained.

As noted above in connection with FIG. 1, the flashlight 10 is positioned within holder 12. That holder, as will be noted from FIGS. 1 to 3, is in the form of a tubular sleeve whose axis is vertical and which has opposed open ends **12*a* and 12*b* within and through which the flashlight is positioned. An upstanding contact plate 72 (FIG. 4) having contact elements 72*a* on opposite surfaces thereof (connected to battery charging conductor 16) is mounted within the holder 12. The contact plate is sandwiched in place as shown in FIGS. 2 and 3. In particular, the holder 12 includes a mounting part 74 screwed thereto by screws 76 and which maintains the contact plate in position (FIG. 3). A mounting plate 78 is attached by the screws 76 to the part 74, and the plate 78 in turn is mounted against the wall 14** or other suitable support structure.

As shown in FIG. 2, the contact plate 72 is positioned so that it is within the channel 70 of the flashlight housing, and particularly so that the contact elements **72*a* are in electrical contact with the switch contacts 58 and 64. It will be noted from FIG. 2 that the lowermost end of the switch housing 60 rests upon a ledge 80 included within the tubular holder 12. The ledge constitutes an abutment against which the flashlight switch housing sits to support the flashlight within the holder 12** in the battery charging position.

It will be noted that the holder 12 includes an inclined upper edge 82, shown clearly in FIG. 1. With such an inclined upper edge, regardless of how the flashlight is initially oriented as it is positioned within the holder, as it is moved downwardly it always assumes the appropriate final orientation so that the contact plate within the holder is properly in position within the channel 70 making electrical contact with the switch contacts 58 and 64. In particular, if the flashlight is not oriented properly, the housing 62 will engage the inclined edge 82 and move downwardly so that the housing 62 is ultimately positioned within channel 84 within the holder 12 (FIG. 3), properly positioning the flashlight within the holder.

The invention has been described in terms of a presently preferred embodiment thereof. It should be apparent that the embodiment described is subject to modification. Accordingly, the invention should be taken to be defined by the following claims.

I claim:

1. A rechargeable flashlight comprising a switch housing having an on/off switch contact therein for controlling operation of said flashlight, said housing including means for directly connecting said switch contact to the charging contact of a battery charging circuit, in which said switch housing comprises a body portion and a slide portion, said switch contact being carried by one of said switch housing portions, and in which said body and slide portions are spaced apart in parts thereof to define a channel therebetween for receiving said charging contact of said battery charging circuit.

2. A flashlight according to claim 1, in combination with a holder for mounting said flashlight and carrying said charging contact in electrical-contacting position with said switch contact within said channel.

3. A flashlight/holder combination according to claim 2, in which said channel is open downwardly when said flashlight is in a vertical position, and said holder mounts said flashlight in vertical position.

4. A rechargeable flashlight comprising a switch housing having an on/off switch contact therein for controlling operation of said flashlight and connectable directly to the charging contact of a battery charging circuit, in which said switch contact is part of an electrical circuit within said flashlight to energize a lamp within said flashlight, said housing including a channel within which said switch contact is positioned, said channel having an open end thereof through which said charging contact of said battery charging circuit passes to be positioned within said channel in electrical contact-making position against said switch contact.

5. A flashlight according to claim 4, in which said housing includes a second switch contact positioned within said channel and which forms with said first mentioned switch contact a pair of opposed switch contacts selectively connectable to each other to complete said circuit within said flashlight to energize said lamp, in combination with a charging circuit that includes said charging contact, said charging contact comprising a plate having electrical contact elements mounted on opposite sides thereof which are brought into electrical contact-making position each against an individual one of said switch contacts.

6. A rechargeable flashlight comprising a housing mounted on the exterior of said flashlight, said housing having an enclosed channel therein open at one end thereof, and a contact within said channel, said contact constituting one of the switch contacts of an on/off switch contained within said housing in said flashlight for controlling operation of said flashlight and connectable to a contact member of a battery charging circuit insertable into said housing through said open housing end for charging a battery within said flashlight.

7. A flashlight according to claim 6, in combination with a holder for mounting said flashlight and carrying a contact member of a battery charging circuit in electrical-contacting position with said contact within said channel in the off position of said switch.

8. A holder for holding a flashlight for battery recharging in which the flashlight includes a contact within a channel of a housing on the exterior of said flashlihgt, and said channel is wholly enclosed except for a downwardly-opening open end thereof, comprising a tubular sleeve having a vertical axis and opposed open ends within and through which said flashlight is positioned, and an upstanding contact plate having a contact element thereon and mounted within said sleeve intermediate said open ends and in spaced relation to the inner surface of said sleeve, said contact element of said contact plate being in electrical-contacting position with said contact within said flashlight housing channel when said flashlight is positioned within said tubular sleeve.

9. A flashlight holder according to claim 8, in which said tubular sleeve includes a ledge therein constituting an abutment against which said flashlight housing sits to support said flashlight within said holder.

* * * * *